US007993219B2

(12) United States Patent
Whitney et al.

(10) Patent No.: US 7,993,219 B2
(45) Date of Patent: Aug. 9, 2011

(54) BAT SWING TRAINING DEVICE

(75) Inventors: Charles E. Whitney, Boxford, MA (US); Kate A. Whitney, Boxford, MA (US); Anthony L. Mandia, Manchester, MA (US)

(73) Assignee: Swingrite LLC, Boxford, MA (US)

( * ) Notice: Subject to any disclaimer, the term of this patent is extended or adjusted under 35 U.S.C. 154(b) by 65 days.

(21) Appl. No.: 12/539,274

(22) Filed: Aug. 11, 2009

(65) Prior Publication Data

US 2010/0041500 A1 Feb. 18, 2010

Related U.S. Application Data

(60) Provisional application No. 61/087,969, filed on Aug. 11, 2008.

(51) Int. Cl.
*A63B 69/00* (2006.01)

(52) U.S. Cl. ..... 473/457

(58) Field of Classification Search ..... 473/457, 473/519, 520, 564–568, 234
See application file for complete search history.

(56) References Cited

U.S. PATENT DOCUMENTS

| | | | | | |
|---|---|---|---|---|---|
| 2,772,887 | A | | 12/1956 | Blake | |
| 3,136,546 | A | * | 6/1964 | Connolly | 473/234 |
| 3,572,706 | A | * | 3/1971 | Schroder | 473/234 |
| 4,317,567 | A | | 3/1982 | Blake | |
| 4,511,139 | A | * | 4/1985 | Armstrong | 473/457 |
| 4,600,190 | A | * | 7/1986 | Berokoff | 482/129 |
| 4,614,343 | A | | 9/1986 | Radway | |
| 4,671,508 | A | * | 6/1987 | Tetreault | 473/457 |
| 4,898,386 | A | * | 2/1990 | Anderson | 473/457 |
| 5,360,209 | A | * | 11/1994 | Mollica | 473/457 |
| 5,590,875 | A | * | 1/1997 | Young | 473/457 |
| 5,803,840 | A | * | 9/1998 | Young | 473/457 |
| D404,097 | S | | 1/1999 | Tyner | |
| 6,050,908 | A | | 4/2000 | Muhlhausen | |
| 6,139,451 | A | | 10/2000 | Hillerich, III et al. | |
| 6,173,610 | B1 | * | 1/2001 | Pace | 73/493 |
| D457,929 | S | | 5/2002 | Ciesar et al. | |
| D461,213 | S | | 8/2002 | Smith | |
| 6,565,462 | B1 | | 5/2003 | Gregg | |
| 6,569,042 | B2 | | 5/2003 | LaChance et al. | |
| D483,827 | S | | 12/2003 | Ciesar | |
| 6,830,520 | B1 | * | 12/2004 | Bollar | 473/457 |
| 6,949,036 | B2 | | 9/2005 | Ciesar et al. | |
| 7,147,580 | B2 | | 12/2006 | Nutter et al. | |
| 7,297,077 | B1 | | 11/2007 | Battaglino | |
| 7,297,078 | B2 | * | 11/2007 | Libonati | 473/457 |
| 2002/0193187 | A1 | * | 12/2002 | Bickel et al. | 473/457 |
| 2005/0153797 | A1 | * | 7/2005 | Nutter et al. | 473/457 |
| 2010/0234144 | A1 | * | 9/2010 | Sutlovich et al. | 473/457 |
| 2010/0248867 | A1 | * | 9/2010 | Tande | 473/457 |

* cited by examiner

*Primary Examiner* — Mark S Graham
(74) *Attorney, Agent, or Firm* — George A. Herbster

(57) ABSTRACT

A bat swing training device for enabling the diagnosis and correction of an individual batter's swing. The training device includes a conventional bat modified to receive a training aid at its distal end in either an exposed extended assembly or an embedded assembly. The training aid provides a snapping sound if an individual swings the bat at greater than a predetermined speed. The position of the batter's hands at the time of the snap indicates whether the batter's swing is correct.

5 Claims, 9 Drawing Sheets

BAT SWING TRAINING DEVICE

CROSS REFERENCE TO RELATED APPLICATION

This application claims priority from U.S. Ser. No. 61/087,969 filed Aug. 11, 2008 for a Bat Swing Adjustable Training Aid.

BACKGROUND OF THE INVENTION

1. Field of the Invention

This invention generally relates to instructional devices for improving an individual's bat swing and more particularly to an instructional device that enables an individual to achieve a proper bat swing for improved hitting.

2. Description of Related Art

The prior art is replete with diverse apparatus for improving the quality of an individual's bat swing. Examples are shown in the following United States Letters Patent:

| | |
|---|---|
| 6,050,908 (2000) | Muhlhausen |
| 6,565,462 (2003) | Gregg |
| 6,569,042 (2003) | LaChance et al. |
| 6,949,036 (2005) | Ciesar et al. |
| 7,147,580 (2006) | Nutter et al. |
| 7,297,077 (2007) | Battaglino |

U.S. Pat. Nos. 6,050,908 and 6,949,036 and 7,147,580 and 7,297,077 disclose bat simulators used for training. In addition, U.S. Pat. No. 7,147,580 includes a sliding mass that apparently changes the dynamics of the bat. None of these references discloses a training aid that has the look and feel of a conventional baseball bat. U.S. Pat. Nos. 6,050,908 and 6,565,462 require that a ball be thrown to the person using the training device. U.S. Pat. No. 6,569,042 provides speed information, but not all the information necessary to provide proper swing information.

SUMMARY

Therefore it is an object of this invention to provide an improved bat swing training device for enabling individuals to obtain a proper swing for maximum impact.

Another object of this invention is to provide an improved bat swing training device that eliminates the need for contact with a thrown ball.

Still another object of this invention is to provide an improved bat swing training device that facilitates the correction of an individual's swing.

Yet still another object of this invention is to provide an improved bat swing training device that closely emulates the physical and visual characteristics of a conventional bat.

In accordance with one aspect of this invention, a bat swing training device for use in correcting a batter's swing includes a conventional baseball bat with a proximal handle or grip, a barrel portion and a distal barrel end. A training device includes a structure that, at a predetermined bat speed, releases a ring to slide along a tubular housing and to snap against a distal stop. An axial passage extends proximally from the distal tip into the bat to receiving the training aid which is affixed to the bat.

In accordance with another aspect of this invention a bat swing training aid includes a bat with a handle, a tip and a closed end receptacle extending from an opening at the tip toward the handle. A training aid is inserted in the receptacle.

The training aid includes a tubular housing with a threaded end portion at the tip and attached to the bat at the closed end of the receptacle. A force adjuster threads onto the tubular housing at the tip end for defining a distal stop. A ring slides on the tubular housing between a cocked position proximate the closed end of the tubular housing and the force adjuster. A restraining assembly selectively restrains the axial position of the ring and includes at least one ring-engaging finger passing through a slot proximate the handle end of the tubular housing. A cartridge slidably mounts in the tubular housing and includes a bias structure that is in contact with the force adjuster. The cartridge retracts the at least one ring-engaging finger to release the ring from its cocked position so it slides to the distal stop when the bat is swung. A structure attached to the cartridge extends through and beyond the force adjuster for enabling the manual displacement of the cartridge whereby the ring can return to its cocked position.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF ILLUSTRATIVE EMBODIMENTS

First Embodiment

Figure 1:
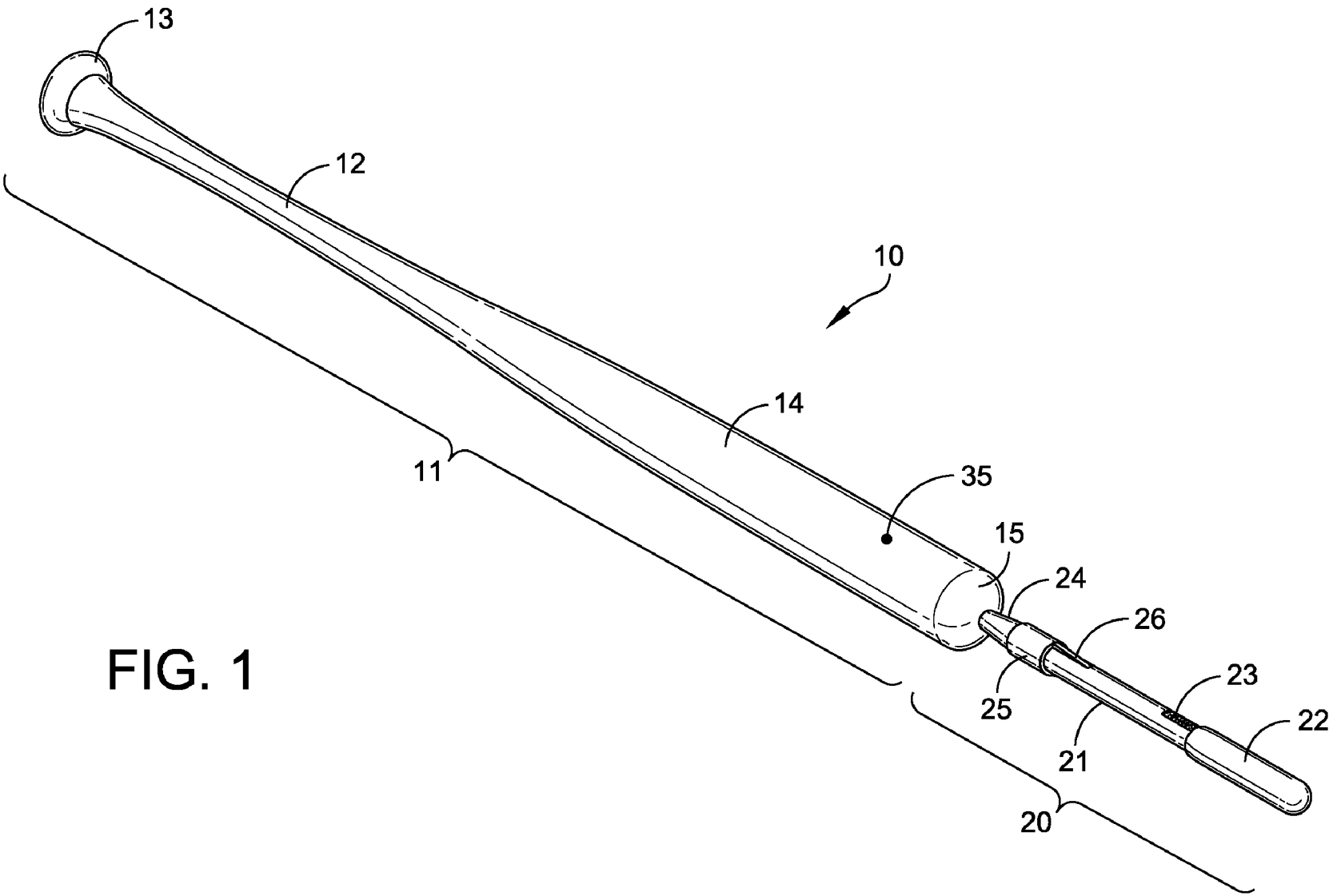
FIG. 1 is a perspective view of a bat swing training device that incorporates this invention.

FIG. 1 depicts a bat swing training device 10 for correcting errors in the swing of a baseball player. The bat swing training device 10 includes a conventional bat 11 having a handle or grip portion 12, a proximal knob or butt end 13, an integral barrel 14 and a distal barrel end or tip 15.

The bat 11 is modified to receive a training aid 20 that includes a cylindrical housing 21, a force adjuster 22, an index 23, a collar 24 and a sliding ring 25. Diametrically located fingers 26, only one is shown in FIG. 1, block distal motion of the sliding ring 25 over the housing 21. However, when a batter achieves sufficient bat speed, the fingers 26 collapse and release the sliding ring 25 so it accelerates along the housing 21 and snaps into a distal stop, in this embodiment the force adjuster 22. The force adjuster 22 and the index 23 act to control the force required to collapse the fingers 26.

Figure 2:
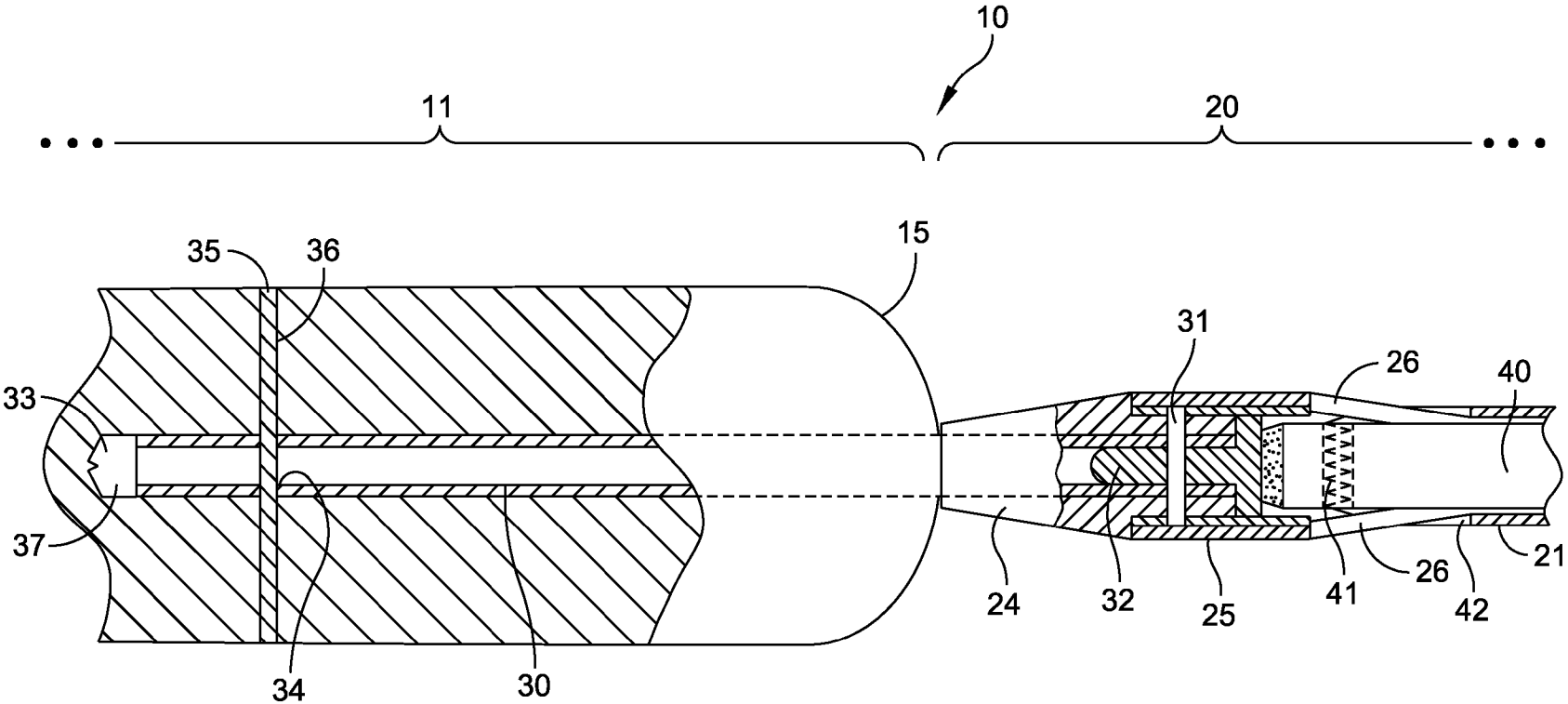
FIG. 2 is an enlarged portion of the bat swing training device at the distal end of a bat and adjacent the proximal portion of the training aid in partial cross-section.

More specifically and is shown in FIG. 2, the training aid 20 includes an axially and proximally extending tube 30 held in the housing 21 by a transverse pin 31 and an expander pin 32. The pin 31 extends through the collar 24 thereby to affix the entire structure to the housing 21.

The proximal extension of the tube 30 lies in a passage 33 that extends proximally and axially from the distal barrel end 15 of the bat 11. The tube 30 also includes a radial passage 34 near its proximate end. A pin 35 passes through a radial passage 36 of the bat and the radial passage 34 to be fixed in the bat either by press fit, adhesive or other means. FIG. 1 depicts one end of the pin 35.

The training aid 20 has the general construction as shown in U.S. Pat. No. 4,614,343. As shown in FIG. 2, the fingers 26 can deflect radially and are carried by a cartridge 40. More specifically, a transverse spring 41 causes the fingers 26 to expand radially through slots 42 in the housing 21.

The force required to move the cartridge 40 distally is determined by the position of the force adjuster 22 that controls the length of a compression spring that bears against the cartridge 40 and opposes its distal motion. In a normal position with the sliding ring 25 in a proximal position shown in FIG. 2, the fingers 26 block any distal motion by the sliding ring 25. However, if sufficient force is exerted during the swing to overcome the spring compression, the cartridge 40 moves distally. As this motion occurs, the housing 21 bears against the fingers 26 to rotate them radially to the center line of the training aid through the slots 42 thereby compressing the spring 41. This releases the sliding ring 25 so it accelerates along the length of the housing 21 to snap against the force adjuster 22.

When an individual swings a bat properly, the swing begins with the wrists cocked. The initial portion of the swing while the wrists are cocked does not produce a force that is sufficient to displace the cartridge 40 in FIG. 2. However, when the wrists release, the bat speed increases. The resulting force component acting along the axis of the training aid 20 can reach a level that overcomes the opposing force of the compression spring. Now the fingers retract so the sliding ring 25 can accelerate along the housing 21. As will be apparent, after each swing, the individual pulls the sliding ring 25 back to the position shown in FIGS. 1 and 2 for the next practice spring.

Typically an individual batter begins training with the force adjuster 22 at a minimum force position. As training progresses, the force is opposing motion of the cartridge 40 is increased as the individual demonstrates both proper swing characteristics. As the force adjuster 22 increases the force, the bat speed required to make the ring snap also increases, so the batter's swing becomes more critical.

Second Embodiment

Figure 3:
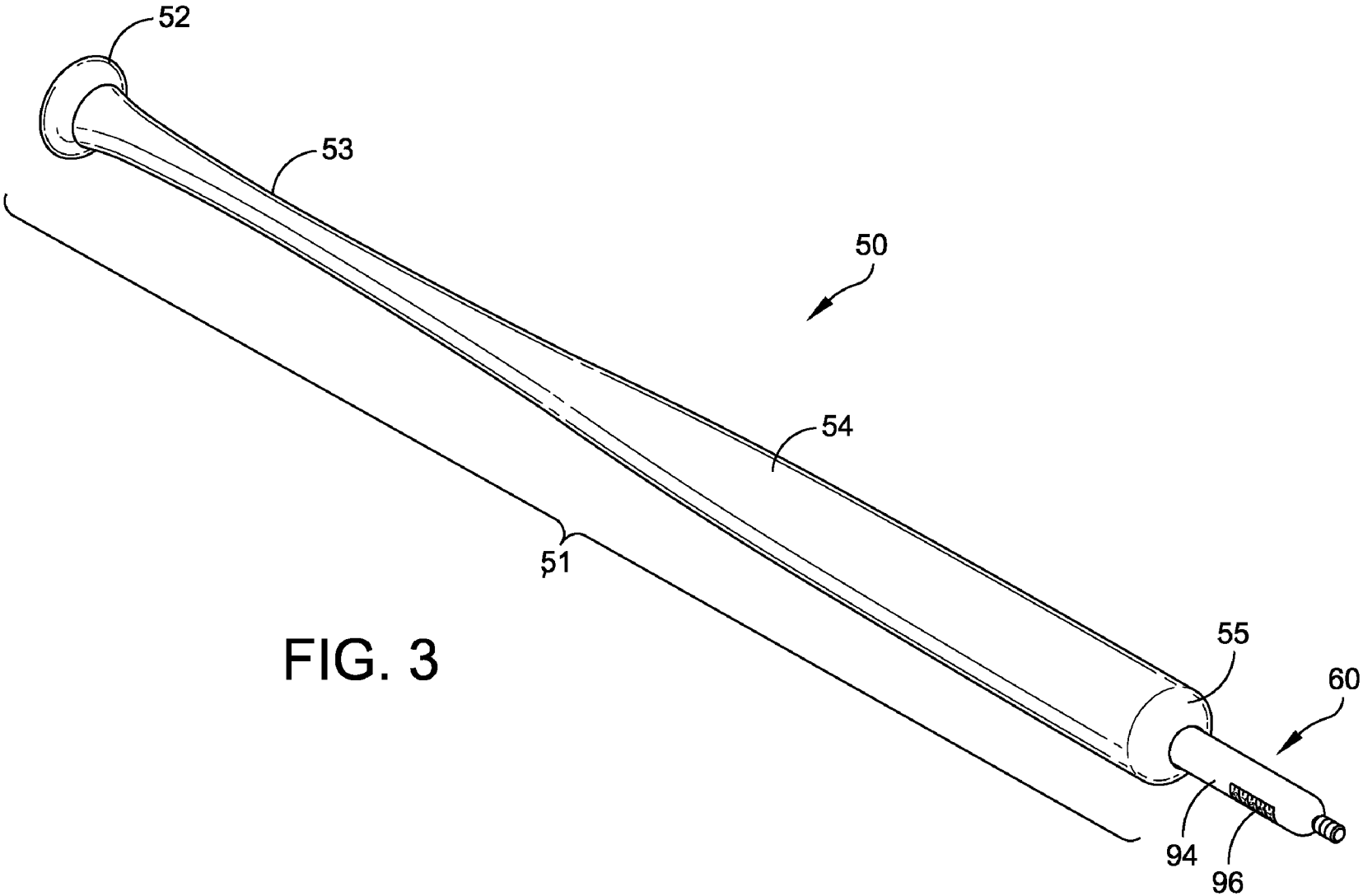
FIG. 3 is a perspective view of another embodiment of a bat swing training device that incorporates this invention.
Figure 4:
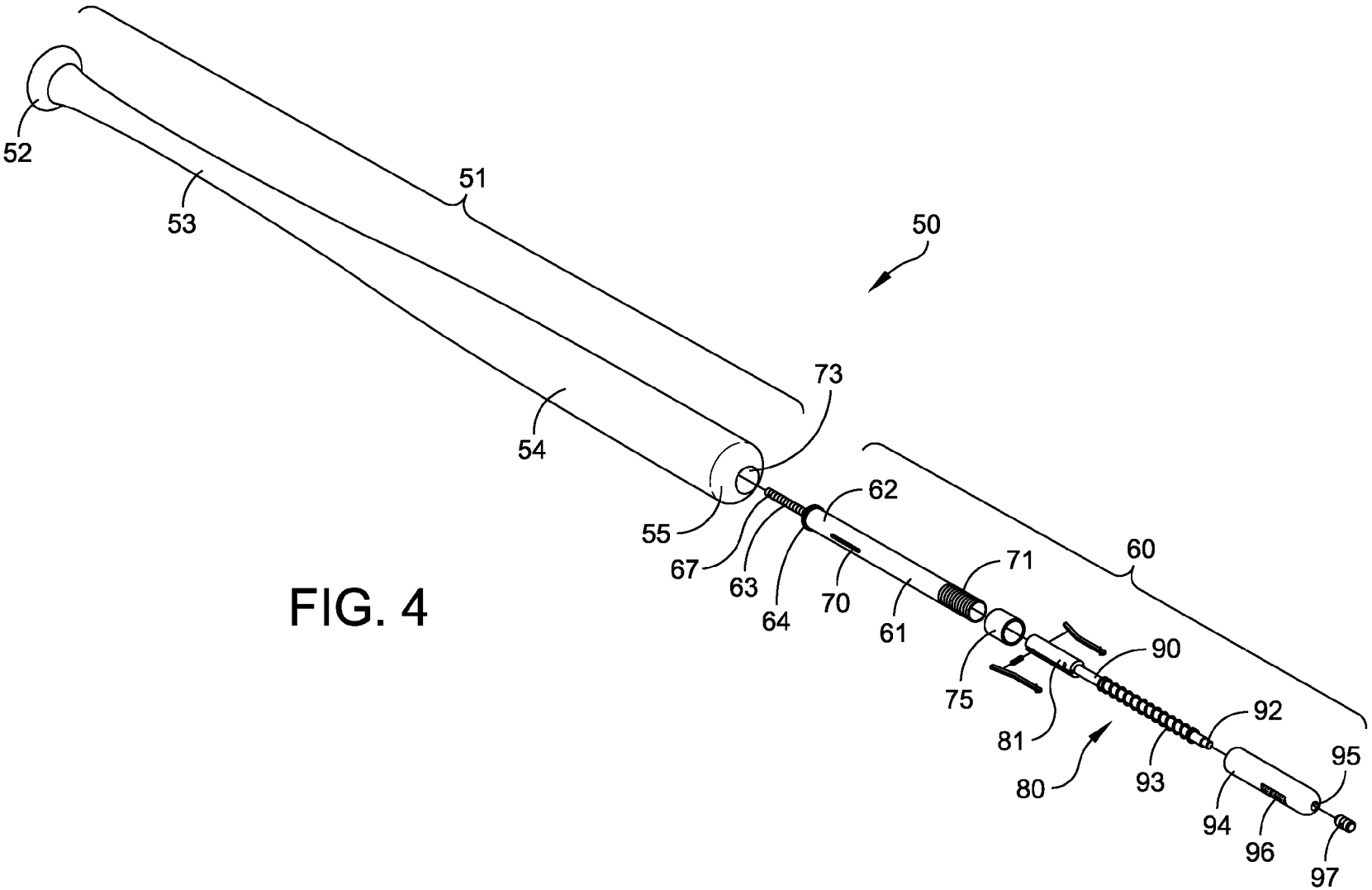
FIG. 4 is an exploded view of the bat swing training device shown in FIG. 3.

FIGS. 3 through 9 depict a second embodiment of a bat swing training device 50 that incorporates this invention. As shown in FIGS. 3 and 4, in this embodiment, this bat swing training device 50 includes a standard bat 51 having a proximal knob 52, adjacent handle 53, barrel 54 and distal tip 55. As will now be described, the bat 51 is adapted to be a bat swing training device by the addition of a training aid 60 that essentially is embedded in the bat 51 whereas the embodiment of FIGS. 1 and 2 extends beyond the bat distal tip 55 by a significant distance.

Now referring to FIGS. 4 through 7, the training aid 60 includes a tubular housing 61 that extends distally from a proximal end 62 that carries an end fitting 63. As particularly shown in FIG. 7, the end fitting 63 includes a flange 64 that covers the end 62, a plug 65 that extends distally into the tubular housing 61 and a cross pin 66 that secures the end fitting 63 to the tubular housing 61. The flange 64 has a greater diameter than the tubular housing 61. As later described, the flange 64 serves as a proximal stop. The end fitting 63 also includes an integral axially oriented threaded extension 67. The tubular housing 61 additionally includes diametrically opposed slots 70 spaced from the flange 64.

Figure 6:
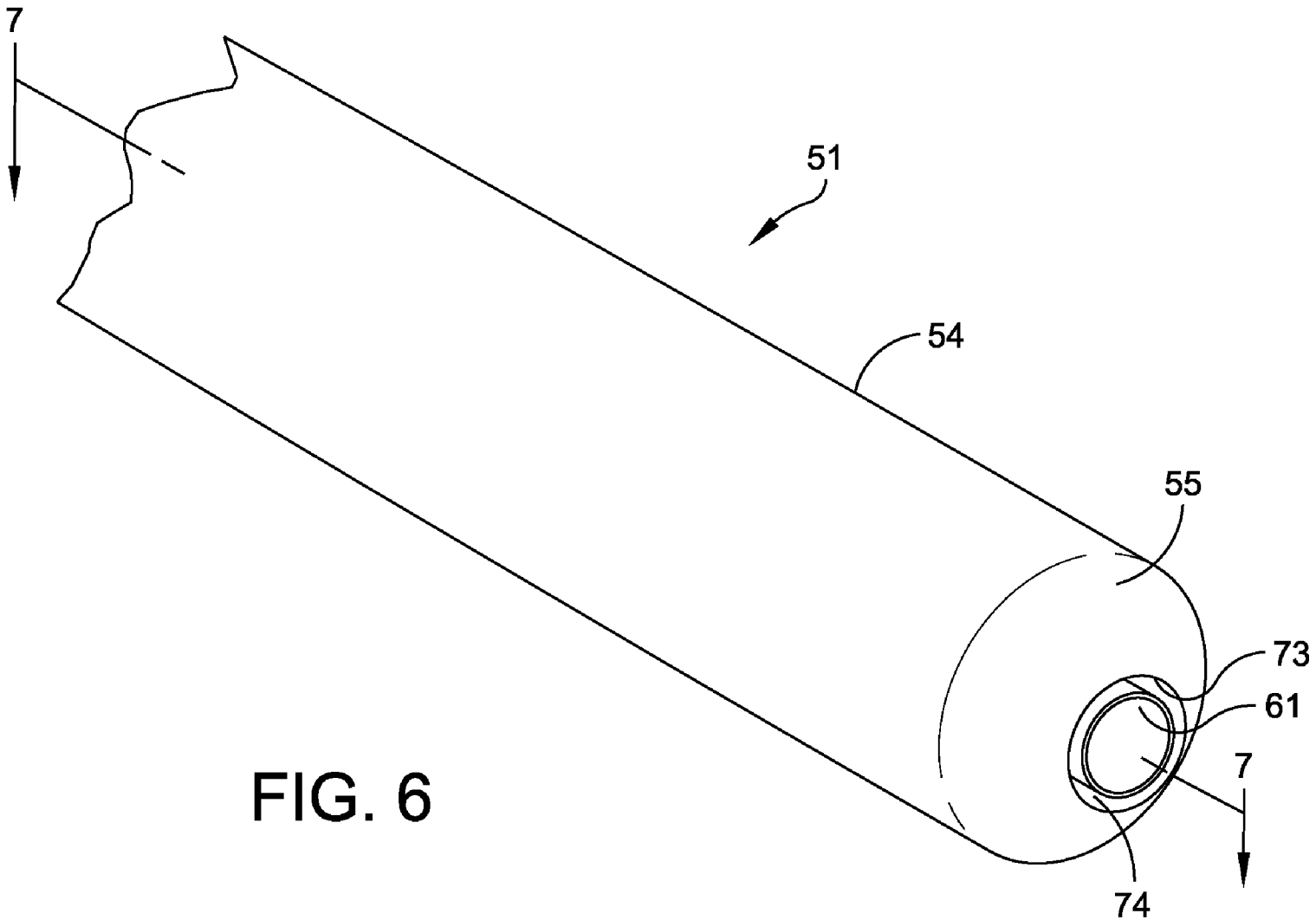
FIG. 6 is a perspective of a bat adapted for receiving the mechanism shown in FIG. 5.
Figure 7:
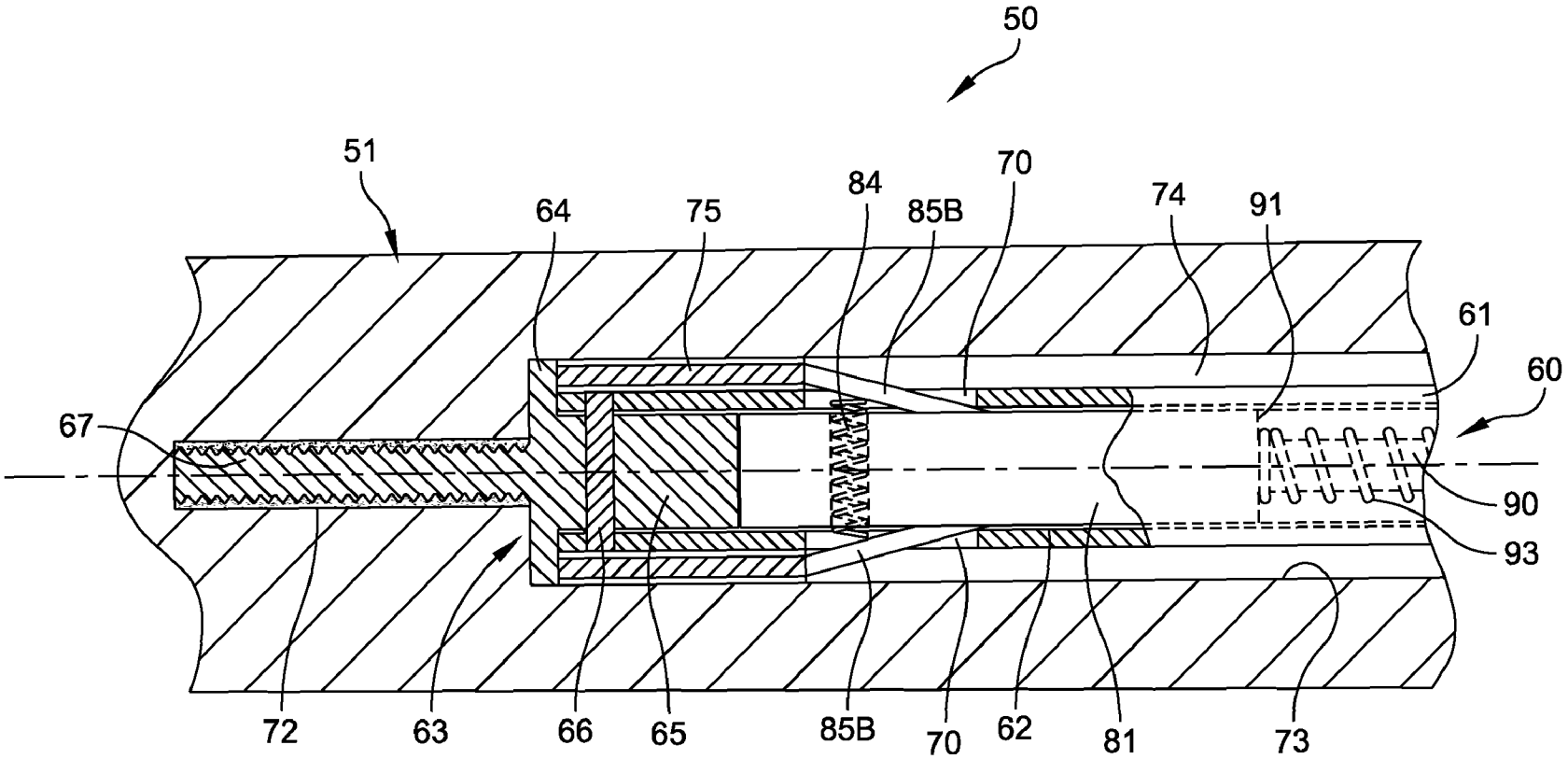
FIG. 7 is a sectional view taken along lines 7-7 in FIG. 6 that depicts the bat swing training device with a ring in a cocked position.

Now referring to FIGS. 4, 6 and 7, the tubular housing 61 is embedded in the bat 51. As a first step in constructing this embodiment, an axially extending pilot hole 72 is drilled or otherwise formed from the tip 55 for a distance substantially equal to the overall length of the tubular housing 61. A main counter bore 73 chases the pilot bore 72 for a distance that essentially corresponds to the distance from the distal end of the threaded extension 71 to the flange 64. The pilot hole 72 can then be partially filled with an epoxy or other material to bond the axial extension 67 to the bat 51. The exterior surface of the tubular housing 61 and the bat surface surrounding the counter bore 73 form a cylindrical passage 74.

After the tubular housing 61 is assembled to the bat 51, a ring 75 is inserted over the threaded end 71 to slide along the tubular housing 61 in the cylindrical passage 74. When the ring 75 abuts the plug 65, it is proximal of the slots 70 so the slots 70 remain clear.

Figure 5:
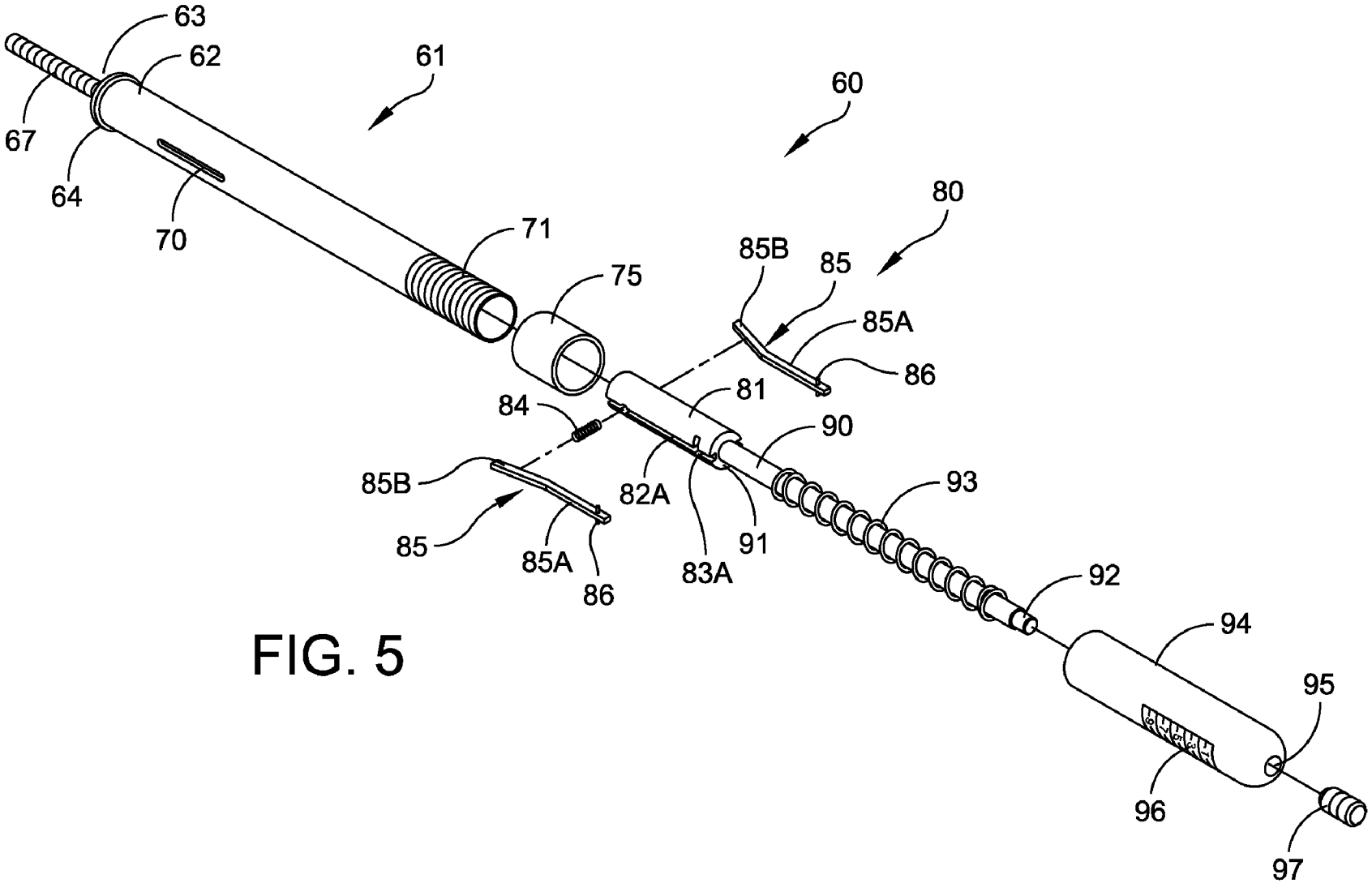
FIG. 5 is an enlarged exploded view of one embodiment of a mechanism useful in the bat swing training device shown in FIG. 3.

Referring to FIGS. 4, 5 and 7, the training aid 60 also includes a restraining assembly 80 that controls the axial position of the ring 75. The assembly 80 includes a cartridge 81 with diametrically opposed axial channels 82, one being shown in FIG. 5. Each axial channel 82 has an associated cross slot 83 adjacent the distal end thereof and a passage for receiving a transverse spring 84 adjacent the proximal end thereof.

Each of fingers 85 includes a first portion 85A and a second angled portion 85B. Each portion 85A includes a transverse pin 86 that mates with a corresponding one of the transverse slots 83. During assembly the finger portions 85A are adapted to lie in the channels 82 while the finger portions 85B are biased outwardly as particularly shown in FIG. 7.

In this embodiment, an elongated rod 90 extends from the distal end of the cartridge 81 thereby to form an extension thereof and an annular shoulder 91. The rod 90 includes a threaded portion 92 at the distal end thereof.

As a next step of assembly, the arm portions 85B are compressed and restrained so that the cartridge 81 and arms 85 can slide into the tubular housing 61. When the proximal end of the cartridge 81 strikes the distal end of the plug 65, the arm portions 85B essentially are axially coextensive with, but not necessarily angularly aligned with, the slots 70. The rod 90 then can be rotated. When the finger portions 85B come into angular alignment with the slots 70, the finger portions 85B snap radially outward to the position shown in FIG. 7 into the cylindrical passage 74 to block movement of the ring 75.

When this process has been completed, a compression spring 93 can be fed onto the rod 90 to abut the shoulder 91 at its proximal end. Then an adjuster 94 having a passage 95 is slid over the rod 90. The adjuster 94 additionally includes indicia 96 that provide a gauge for use in establishing the force level. The adjuster 94 is internally threaded to engage the externally threaded section 71. As the adjuster 94 advances proximally over the threaded section 71, it will eventually reach a point at which the threaded end 92 of the rod 90 passes through the passage 95. At this point a finger gripping nut 97 can be affixed to the threaded portion 92 externally of the adjuster 94.

Operation

Figure 8:
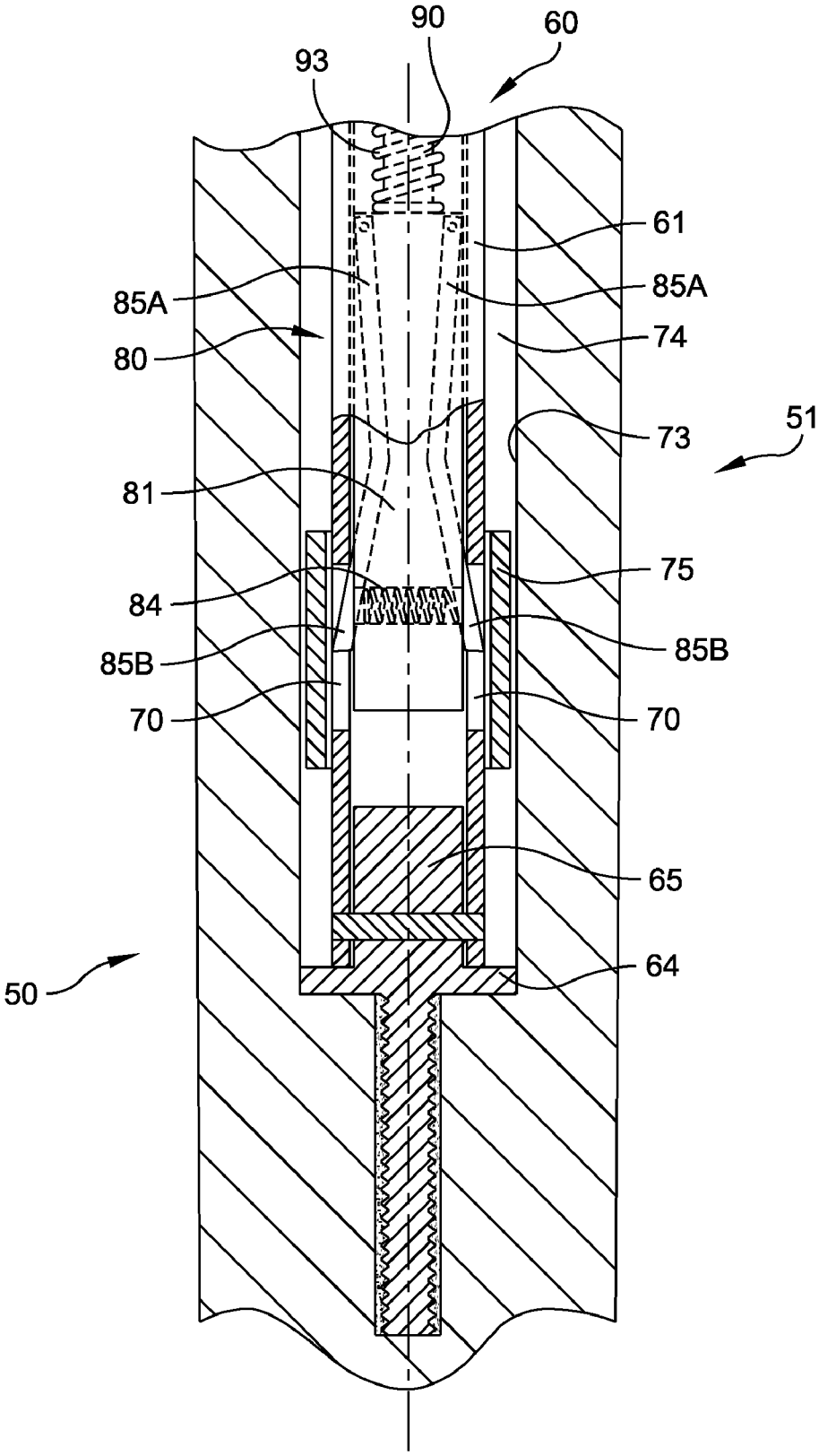
FIG. 8 is the view of FIG. 7 that depicts a ring at an intermediate position of the bat swing training device after it is released.

During use both embodiments operate in a similar manner during a bat swing. Specifically, when the bat swing training aid 50 in FIG. 3 is swung and reaches a velocity determined by the amount the adjuster 94 has advanced along the tubular housing 61. When this velocity has been attained, the centripetal force provided by the spring 93 in FIGS. 4, 5 and 7 through 9 will be overcome due to the inertia of the ring 75 and the cartridge 81. The cartridge 81 then moves distally, to the right in FIG. 7. The interference between the tubular housing 61 adjacent the slots 70 and the finger portions 85B causes them to compress the spring 84 and close into the slots 70. As shown in FIG. 8, at some point, the tips of fingers 85 compress to a point inside the diameter of the ring 75 whereupon the ring 75 accelerates distally, being released from its cocked position, accelerates along the tubular housing 61 until it strikes the adjuster 94 with an audible snapping or clicking noise.

Figure 9:
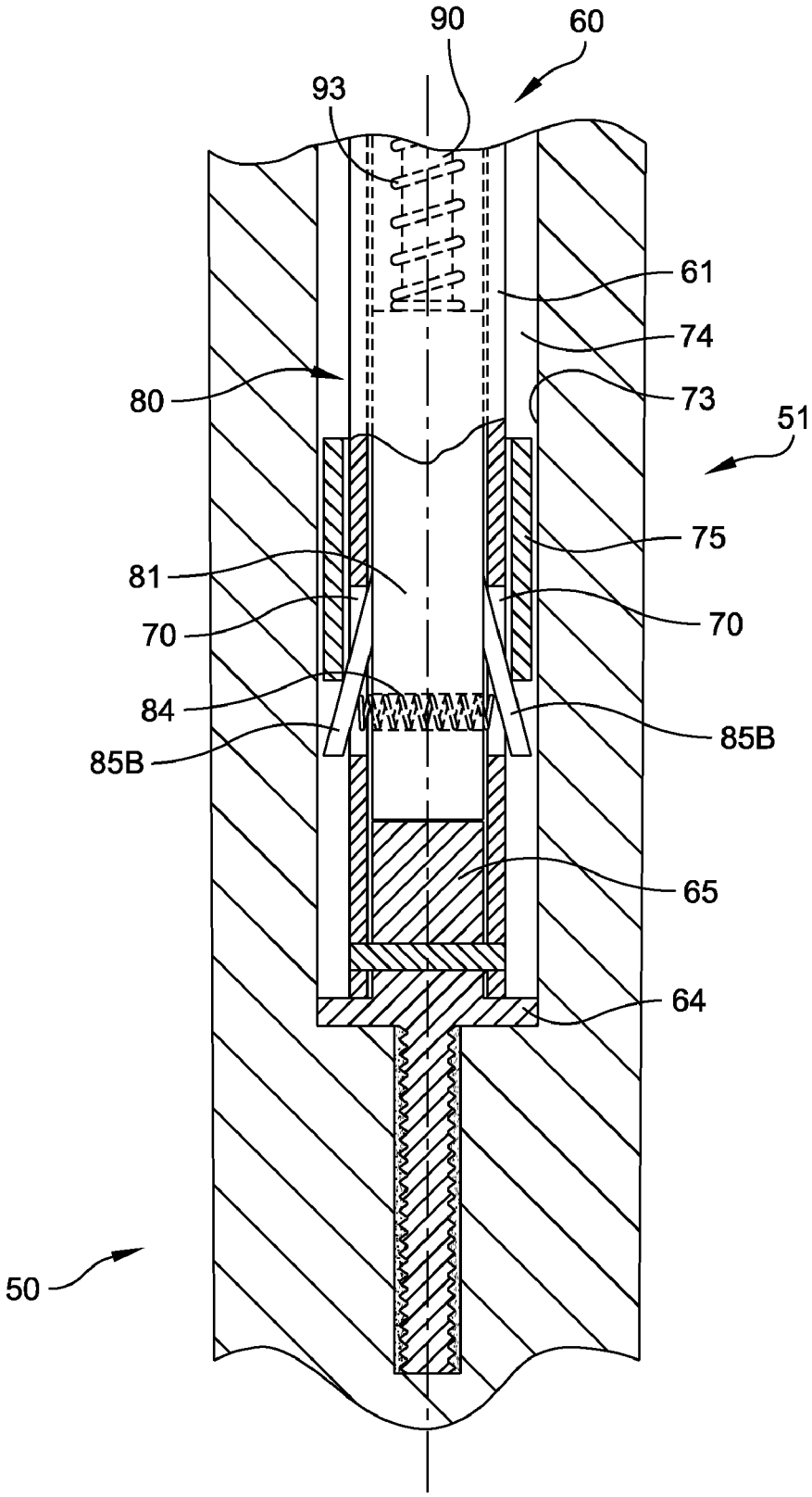
FIG. 9 depicts the ring at another intermediate position blocked from being returned to the cocked position.

In the embodiment of FIGS. 1 and 2, an individual recocks the ring 25 by sliding it back to its original position thereby compressing the fingers 26 to allow the ring 25 to reach its cocked position. However, in the embodiment of FIGS. 3 through 9 there is no manual access to the fingers 85A and 85B or no ability to move the ring 75 as the ring 75 is hidden within the main counter bore 73. In this embodiment the individual orients the bat 51 vertically with the tip 55 in an upward position as shown in FIG. 9. The ring 75 slides to the fingers 85 that block the ring 75 from traveling to the flange 64.

Then the individual pulls the exposed finger grip 97 in FIG. 5 in an upward direction relative to the orientation of FIG. 8. As a result, the cartridge 81 moves distally through the intermediate position in FIG. 9. At this point, the fingers 85 compress the spring 84 and allow the ring 75 to drop due to gravity and to come to rest in its original position against the flange 64. The result is the bat swing training aid 50 provides an even more accurate simulation of a normal bat for swinging.

Thus it now will be apparent that the bat swing training devices shown in FIGS. 1 through 9 meet all the objectives of this invention. Specifically, this training device is adapted for use with both baseball and softball bats and is useful in enabling a batter to perfect his or her swing. There is no need for a ball to be thrown. Finally, each bat swing training device has the look and feel of a conventional baseball bat, any additional weight introduced by the training aid being less than a batter would use with a conventional weighted practice bat.

It will be apparent from the foregoing description that many variations and modifications can be made of this invention. Therefore, it is the intent of the appended application to cover all such variations and modifications as come within the true spirit and scope of this invention.

The invention claimed is:

1. A bat swing training aid comprising:

A) a bat with a proximal handle, a barrel and a distal tip and a closed end receptacle extending proximally from an opening at the tip, and B) a training aid in said receptacle, said training aid comprising:

i) a tubular housing having a threaded end adjacent the tip and means for attaching said housing to the bat at the closed end of said receptacle whereby said tubular housing is embedded in said bat, ii) a force adjuster threaded onto said tubular housing at the tip end for defining a distal stop, iii) a ring for sliding on said tubular housing between a cocked position proximate the closed end of said tubular housing and said adjuster, iv) restraining means for selectively restraining the axial position of said ring including:

a) at least one ring-engaging finger passing through a slot proximate the handle end of said tubular housing, b) a cartridge slidably mounted in said tubular housing including bias means for contact with said adjuster, said cartridge retracting said at least one ring-engaging finger for releasing said ring from its cocked position to slide to the distal stop when said bat is swung, and c) means attached to said cartridge and extending through and beyond said force adjuster for enabling the manual displacement of said cartridge whereby said ring can return to its cocked position.

2. A bat swing training aid as recited in claim 1 wherein said force adjuster includes internal threads for engaging the threaded end of said tubular housing and said restraining means additionally includes a spring intermediate said cartridge and said force adjuster.

3. A bat swing training aid as recited in claim 2 wherein said displacement enabling means includes:

i) a rod attached to said cartridge that extends through a passage in said force adjuster, and ii) finger grip attached to the distal end of said rod externally to said force adjuster.

4. A bat swing training aid as recited in claim 3 wherein said force adjuster includes indicia formed thereon for enabling an individual to gage the force asserted by said spring.

5. A bat swing training aid as recited in claim 4 where said restraining means comprises first and second ring-engaging fingers and said tubular housing includes first and second slots.

* * * * *